US007946813B2

(12) United States Patent
Fukuda et al.

(10) Patent No.: US 7,946,813 B2
(45) Date of Patent: May 24, 2011

(54) TURBINE ROTOR AND STEAM TURBINE

(75) Inventors: Masafumi Fukuda, Saitama (JP); Takahiro Kubo, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1066 days.

(21) Appl. No.: 11/626,590

(22) Filed: Jan. 24, 2007

(65) Prior Publication Data

US 2008/0085192 A1 Apr. 10, 2008

(30) Foreign Application Priority Data

Oct. 4, 2006 (JP) ..... 2006-272618

(51) Int. Cl.
*F04D 29/04* (2006.01)
*B21K 25/00* (2006.01)

(52) U.S. Cl. ..... 415/216.1; 416/213 R; 29/889.2

(58) Field of Classification Search ..... 415/115, 415/116, 216.1; 416/213 R; 29/889.2
See application file for complete search history.

(56) References Cited

U.S. PATENT DOCUMENTS

| | | | | |
|---|---|---|---|---|
| 6,082,962 | A * | 7/2000 | Drosdziok et al. | 415/115 |
| 6,152,697 | A * | 11/2000 | Konishi et al. | 416/213 R |
| 6,227,799 | B1 * | 5/2001 | Kuhn et al. | 415/115 |
| 6,767,649 | B2 | 7/2004 | Staubli et al. | |
| 7,267,525 | B2 * | 9/2007 | Hiegemann et al. | 415/115 |
| 2005/0022529 | A1 | 2/2005 | Takahashi et al. | |
| 2005/0106407 | A1 | 5/2005 | Scarlin | |

FOREIGN PATENT DOCUMENTS

| | | | |
|---|---|---|---|
| AU | 2004203429 | A1 | 2/2005 |
| CN | 1246579 | | 3/2000 |
| CN | 1576518 | | 2/2005 |
| DE | 69924561D | | 5/2005 |
| DE | 699 24 561 | T2 | 2/2006 |
| EP | 0 964 135 | A2 | 2/1999 |
| EP | 1 502 966 | A2 | 2/2005 |
| ID | 23116 | | 3/2000 |
| JP | 2000-64805 | | 2/2000 |
| JP | 2000-274208 | | 10/2000 |
| JP | 2000-282808 | | 10/2000 |
| JP | 2004-36469 | | 2/2004 |
| JP | 2005-60826 | | 3/2005 |
| KR | B1 10-0330520 | | 3/2002 |
| SG | 87808 | | 4/2002 |
| TW | 394812 | B | 6/2000 |

* cited by examiner

*Primary Examiner* — Edward Look
*Assistant Examiner* — Sean J Younger
(74) *Attorney, Agent, or Firm* — Oblon, Spivak, McClelland, Maier & Neustadt, L.L.P.

(57) ABSTRACT

A turbine rotor 10 is disposed in a steam turbine, into which high-temperature steam of 650° C. or more is introduced, and separately configured of the portion made of the Ni-base alloy and the portion made of the CrMoV steel depending on a steam temperature and a metal temperature, and the individual portions having a small difference in coefficient of linear expansion are welded mutually.

18 Claims, 2 Drawing Sheets

TURBINE ROTOR AND STEAM TURBINE

CROSS-REFERENCE TO RELATED APPLICATIONS

This application is based upon and claims the benefit of priority from the prior Japanese Patent Application No. 2006-272618 filed on Oct. 4, 2006; the entire contents of which are incorporated herein by reference.

BACKGROUND

1. Field of the Invention

The present invention relates to a turbine rotor which is configured by welding separate component parts of the turbine rotor, and more particularly to a turbine rotor of which component parts are made of suitable heat-resisting alloy and heat-resisting steel, and a steam turbine provided with the turbine rotor.

2. Description of the Related Art

Energy saving of the thermal power plant including a steam turbine is being performed vigorously after the energy crisis, and technology for suppression of the emission of $CO_2$ is being watched with interest in view of the global environmental protection in these years. As part of it, needs for a highly efficient plant are increasing.

To increase power generation efficiency of the steam turbine, it is very effective to raise the steam temperature to a high level, and the recent thermal power plant having the steam turbine has its steam temperature raised to 600° C., or more. There is a tendency in the world that the steam temperature of the turbine will be increased to 650° C., and further to 700° C. in future.

The turbine rotor supporting moving blades which are rotated by receiving high-temperature steam has a high temperature because the high-temperature steam flows to circulate around the turbine rotor. Besides, a high stress is generated in the turbine rotor by the rotations of the turbine rotor. Therefore, the turbine rotor must withstand a high temperature and a high stress. Such a turbine rotor may have portions, which have a particularly high temperature, configured of an Ni-base alloy having high strength even at a high temperature. In a case where the Ni-base alloy is used, its manufacturable upper size is limited and the Ni-base alloy costs high, so that it is desirable that the Ni-base alloy is used for only portions which must be made of the Ni-base alloy, and other portions are made of an iron-steel material.

Under the circumstances described above, recently, there has been disclosed a technology to produce a turbine rotor by combining the Ni-base alloy and the iron-steel material. In a case where the turbine rotor is produced by connecting the Ni-base alloy and the iron-steel material by welding or the like, it is general to select the connecting iron-steel material of a type resistant to a high temperature in order to make a size of the portion made of the Ni-base alloy as small as possible. Specifically, a technology is disclosed in, for example, JP-A 2004-36469 (KOKAI) that the turbine rotor of a steam turbine into which steam having a high temperature of 675° C. to 700° C. flows is configured by coupling the Ni-base alloy and 12Cr steel. JP-A 2000-64805 (KOKAI) discloses a technology that the turbine rotor of a steam turbine is configured by coupling 12Cr steel and CrMoV steel.

As described above, the temperatures of main steam and reheated steam have a tendency to become higher in order to obtain high power generation efficiency. And, in a case where the individual portions of the turbine are made of the same material as those of a related art in order to realize a steam turbine in which a steam temperature exceeds 650° C., the steam turbine cannot withstand the high-temperature steam. Accordingly, it is effective to use the Ni-base alloy having high heat resistance for the portion of the steam turbine which has a high temperature.

But, the above-described conventional method for producing the turbine rotor by combining the Ni-base alloy and the 12Cr steel has a drawback that a large thermal stress is generated in the connected portion because a coefficient of linear expansion of the Ni-base alloy is largely different from that of the 12Cr steel.

BRIEF SUMMARY OF THE INVENTION

The invention provides a turbine rotor which can decrease a difference in thermal expansion of a bonded portion between a high-temperature portion and a low-temperature portion of the turbine rotor and can be operated by high-temperature steam of 650° C. or more, and a steam turbine.

According to an aspect of the invention, there is provided a turbine rotor which is disposed in a steam turbine into which high-temperature steam of 650° C. or more is introduced, wherein the turbine rotor is configured by welding to bond a portion made of an Ni-base alloy and a portion made of CrMoV steel which are divided depending on a temperature of steam, and the bonded portion between the portion made of the Ni-base alloy and the portion made of the CrMoV steel and the portion made of the CrMoV steel are kept at a steam temperature of 580° C. or less.

According to another aspect of the invention, there is provided a turbine rotor which is disposed in a steam turbine into which high-temperature steam of 650° C. or more is introduced, wherein the turbine rotor is configured by welding to bond a portion made of an Ni-base alloy and a portion made of CrMoV steel which are divided depending on a metal temperature, and a cooling unit is disposed at the bonded portion between the portion made of the Ni-base alloy and the portion made of the CrMoV steel and the portion made of the CrMoV steel to keep the bonded portion and the portion made of the CrMoV steel, which are exposed to steam having a temperature higher than 580° C., at a metal temperature of 580° C. or less.

According to still another aspect of the invention, there is provided a steam turbine into which high-temperature steam of 650° C. or more is introduced and which is provided with the above-described turbine rotor.

BRIEF DESCRIPTION OF THE DRAWINGS

The present invention is described with reference to the drawings, which are provided for illustration only and do not limit the present invention in any respect.

DETAILED DESCRIPTION OF THE INVENTION

Embodiments of the present invention will be described with reference to the drawings.

First Embodiment

Figure 1:
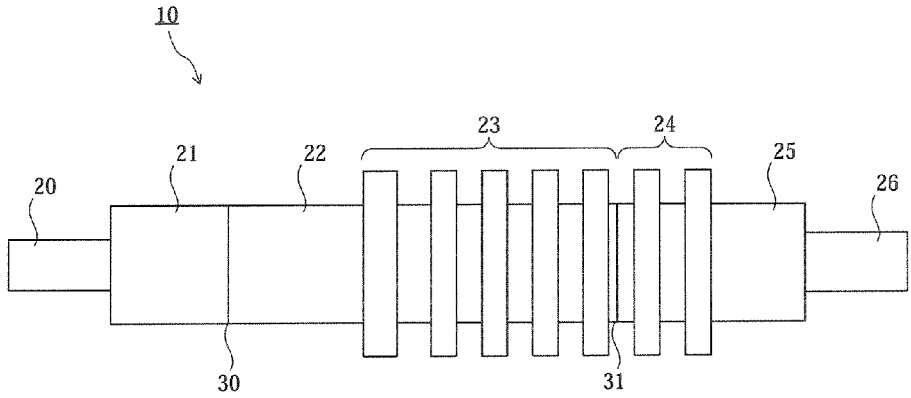
FIG. 1 is a plan view schematically showing the structure of a turbine rotor according to a first embodiment of the invention.

FIG. 1 is a plan view schematically showing the structure of a turbine rotor 10 according to a first embodiment of the invention.

As shown in FIG. 1, the turbine rotor 10 is configured of a front shaft 20, a front low-temperature packing part 21, a front high-temperature packing part 22, a front high-temperature moving blade section 23, a rear low-temperature moving blade section 24, a rear low-temperature packing part 25 and a rear shaft 26.

The front shaft 20 and the front low-temperature packing part 21 are configured as one body. And, the front high-temperature packing part 22 is configured as one body with the front high-temperature moving blade section 23 where the moving blades are implanted. Besides, the rear shaft 26, the rear low-temperature packing part 25 and the rear low-temperature moving blade section 24 where moving blades are implanted are configured as one body. The front low-temperature packing part 21 is connected to the front high-temperature packing part 22 by welding to form a bonded portion 30, and the front high-temperature moving blade section 23 is connected to the rear low-temperature moving blade section 24 by welding to form a bonded portion 31, thereby configuring the single turbine rotor 10 as a whole. The front shaft 20 and the rear shaft 26 each are supported by unshown bearings to hold the turbine rotor 10 horizontally.

The bonded portion 30 and the bonded portion 31 are disposed at positions where they are exposed to steam having a temperature of 580° C. or less to keep the bonded portion 30 and the bonded portion 31 at a metal temperature of 580° C. or less. And, the front low-temperature packing part 21, the rear low-temperature moving blade section 24 and the rear low-temperature packing part 25 are also disposed at positions where they are exposed to steam having a temperature of 580° C. or less to keep the front low-temperature packing part 21, the rear low-temperature moving blade section 24 and the rear low-temperature packing part 25 as well as the front shaft 20 and the rear shaft 26 at the metal temperature of 580° C. or less. Here, the reason of keeping the bonded portion 30, the bonded portion 31, the front shaft 20, the front low-temperature packing part 21, the rear low-temperature moving blade section 24, the rear low-temperature packing part 25 and the rear shaft 26 at the metal temperature of 580° C. or less is that a high limiting temperature at which the materials configuring those portions can be used stably is about 580° C.

Then, the constituent materials for the front shaft 20, the front low-temperature packing part 21, the front high-temperature packing part 22, the front high-temperature moving blade section 23, the rear low-temperature moving blade section 24, the rear low-temperature packing part 25 and the rear shaft 26 configuring the turbine rotor 10 will be described.

(1) Constituent material for the front shaft 20, the front low-temperature packing part 21, the rear low-temperature moving blade section 24, the rear low-temperature packing part 25 and the rear shaft 26

The front shaft 20, the front low-temperature packing part 21, the rear low-temperature moving blade section 24, the rear low-temperature packing part 25 and the rear shaft 26 are made of CrMoV steel usable stably up to a temperature of about 580° C. The CrMoV steel configuring the front shaft 20, the front low-temperature packing part 21, the rear low-temperature moving blade section 24, the rear low-temperature packing part 25 and the rear shaft 26 preferably has a coefficient of linear expansion of $13.3\times10^{-6}$ to $15.3\times10^{-6}$/° C. at 580° C. The CrMoV steel having the coefficient of linear expansion in the above range is preferably used to decrease a difference between the coefficient of linear expansion of the CrMoV steel and the coefficient of linear expansion of the constituent material for the front high-temperature packing part 22 and the front high-temperature moving blade section 23 described later and to suppress a thermal stress from generating in the bonded portions 30, 31 due to a difference in coefficient of linear expansion.

Specific examples of the CrMoV steel include the following materials (M1) and (M2) having the chemical composition ranges described below. The CrMoV steel is not limited to the materials having the following chemical composition ranges but may be CrMoV steel which can be used stably up to a temperature of about 580° C. and has the above-described range of coefficient of linear expansion.

(M1) Iron-steel material which contains in percent by weight C: 0.24 to 0.34, Si: 0.15 to 0.35, Mn: 0.7 to 1, Cr: 0.85 to 2.5, V: 0.2 to 0.3, Mo: 1 to 1.5, and the balance of Fe and unavoidable impurities; and the unavoidable impurities include Ni: 0.5 or less, P: 0.035 or less and S: 0.035 or less.

(M2) Alloy steel which contains in percent by weight C: 0.05-0.15, Si: 0.3 or less (not including 0), Mn: 0.1-1.5, Ni: 1.0 or less (not including 0), Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03 and the balance of Fe and unavoidable impurities; $M_{23}C_6$ type carbide is mainly precipitated on crystal grain boundary and martensite lath boundary by a tempering heat treatment; $M_2X$ type carbonitride and MX type carbonitride are precipitated within the martensite lath; V and Mo contained in the component elements of the $M_2X$ type carbonitride have a relation of V>Mo; and a total precipitate of the $M_{23}C_6$ type carbide, the $M_2X$ type carbonitride and the MX type carbonitride is 2.0-4.0% by weight as described in JP-A 2005-60826 (KOKAI) and U.S. patent application Ser. No. 10/901,370. In addition, reference is hereby made to co-pending U.S. patent application Ser. No. 10/901,370, the entire disclosure of which is incorporated herein by reference.

As the constituent material for the front shaft 20, the front low-temperature packing part 21, the rear low-temperature moving blade section 24, the rear low-temperature packing part 25 and the rear shaft 26, inexpensive low alloy cast steel, for example, 1% CrMoV cast steel may be used.

The unavoidable impurities in the above-described (M1) and (M2) are desirably decreased as low as possible to a residual content of 0%.

(2) Constituent material for the front high-temperature packing part 22 and the front high-temperature moving blade section 23

The front high-temperature packing part 22 and the front high-temperature moving blade section 23 are made of Ni-base alloy usable stably up to a temperature of 650° C. or more, and more specifically to about 700° C. The Ni-base alloy configuring the front high-temperature packing part 22 and the front high-temperature moving blade section 23 preferably has a coefficient of linear expansion of $11.5\times10^{-6}$ to $17\times10^{-6}$/° C. at 580° C. The Ni-base alloy having the coefficient of linear expansion in the above range is preferably used to decrease a difference between the coefficient of linear expansion of the Ni-base alloy and the coefficient of linear expansion of the CrMoV steel configuring the front shaft 20, the front low-temperature packing part 21, the rear low-temperature moving blade section 24, the rear low-temperature packing part 25 and the rear shaft 26 and to suppress a thermal stress from generating in the bonded portions 30, 31 due to a difference in coefficient of linear expansion.

Specific examples of the Ni-base alloy include the following materials (M3) to (M7) having the chemical composition ranges described below. The Ni-base alloy is not limited to the materials having the following chemical composition ranges but may be an Ni-base alloy which can be used stably up to a temperature of 650° C. or more, and more specifically to about 700° C., and has the above-described range of coefficient of linear expansion.

(M3) Ni-base alloy which contains in percent by weight C: 0.05 to 0.15, Si: 0.01 to 1, Mn: 0.01 to 1, Cr: 20 to 24, Mo: 8 to 10, Co: 10 to 15, B: 0.0001 to 0.006, Al: 0.8 to 1.5, Ti: 0.1 to 0.6, and the balance of Ni and unavoidable impurities, and the unavoidable impurities include Fe: 3 or less, Cu: 0.5 or less and S: 0.015 or less.

(M4) Ni-base alloy which contains in percent by weight C: 0.001 to 0.06, Si: 0.01 to 0.4, Cr: 14 to 18, B: 0.0001 to 0.006, Al: 0.1 to 3, Ti: 0.1 to 2, Ni: 39 to 44, and the balance of Fe and unavoidable impurities; and the unavoidable impurities include Mn: 0.4 or less, Co: 1 or less, Cu: 0.3 or less and S: 0.015 or less.

(M5) Ni-base alloy which contains in percent by weight C: 0.01 to 0.1, Cr: 8 to 15, Mo: 16 to 20, Al: 0.8 to 1.5, Ti: 0.1 to 1.5, and the balance of Ni and unavoidable impurities.

(M6) Ni-base alloy which contains in percent by weight C: 0.01 to 0.2, Cr: 15 to 25, Mo: 8 to 12, Co: 5 to 15, Al: 0.8 to 1.5, Ti: 0.1 to 2, and the balance of Ni and unavoidable impurities.

(M7) Ni-base alloy which contains in percent by weight C: 0.01 to 0.2, Cr: 10 to 20, Mo: 8 to 12, Al: 4 to 8, Ti: 0.1 to 2, Nb: 0.1 to 3, and the balance of Ni and unavoidable impurities.

The unavoidable impurities in (M3) to (M7) described above are desirably decreased as low as possible to a residual content of 0%.

The coefficients of linear expansion of the Ni-base alloys having the chemical composition ranges described above are $13\times10^{-6}$ to $15\times10^{-6}$/° C. in (M3), $15\times10^{-6}$ to $17\times10^{-6}$/° C. in (M4), $11.5\times10^{-6}$ to $13.5\times10^{-6}$/° C. in (M5), $12.6\times10^{-6}$ to $14.6\times10^{-6}$/° C. in (M6), and $11.6\times10^{-6}$ to $13.6\times10^{-6}$/° C. in (M7) at 580° C. Specific examples of the Ni-base alloy having the chemical composition range of (M3) include IN617 (manufactured by Inco Ltd.), and specific examples of the Ni-base alloy having the chemical composition range of (M7) include IN713C (manufactured by Inco Ltd.).

A difference between the coefficient of linear expansion of the Ni-base alloy and that of the CrMoV steel is preferably determined to be $2\times10^{-6}$/° C. or less at 580° C. (during the operation of the steam turbine). Thus, the reason why the difference between the coefficient of linear expansion of the Ni-base alloy and that of the CrMoV steel is preferably determined to be $2\times10^{-6}$/° C. or less is that a thermal stress is suppressed from generating in the bonded portions 30, 31 due to the difference in coefficient of linear expansion.

As described above, the coefficients of linear expansion of the Ni-base alloy and the CrMoV steel which are welded at the bonded portion 30 and the bonded portion 31 of the turbine rotor 10 according to the invention are $11.5\times10^{-6}$ to $17\times10^{-6}$/° C. (Ni-base alloy) and $13.3\times10^{-6}$ to $15.3\times10^{-6}$/° C. (CrMoV steel), respectively. In other words, the combination of the Ni-base alloy and the CrMoV steel having the above coefficients of linear expansion can set the difference of the coefficient of linear expansion between them to $2\times10^{-6}$/° C. or less at 580° C. (during the operation of the steam turbine).

Meanwhile, in a case where general 12Cr steel used for the conventional turbine rotor is bonded to the Ni-base alloy, a difference in coefficient of linear expansion between them becomes larger than the difference in coefficient of linear expansion between the Ni-base alloy and the CrMoV steel described above, and it is not desirable because a large thermal stress is generated.

As described above, according to the turbine rotor 10 of the first embodiment, the generation of the thermal stress in the bonded portion can be suppressed because the turbine rotor 10 is separately configured of the portion made of the Ni-base alloy and the portion made of the CrMoV steel depending on a steam temperature and a metal temperature, and the individual portions having a small difference in coefficient of linear expansion are welded mutually. And, it is possible to use the turbine rotor 10 as a turbine rotor provided in the steam turbine in which high-temperature steam of 650° C. or more is introduced by keeping the bonded portion of the portion made of the Ni-base alloy and the portion made of the CrMoV steel and the portion made of the CrMoV steel at a metal temperature of 580° C. or less.

A high-pressure turbine 100 provided with the turbine rotor 10 according to the above-described first embodiment will be described with reference to FIG. 2. An example that the high-pressure turbine 100 is provided with the turbine rotor 10 is described here, but the same action and effect can also be obtained by disposing the turbine rotor 10 in a high-pressure turbine or an intermediate-pressure turbine.

Figure 2:
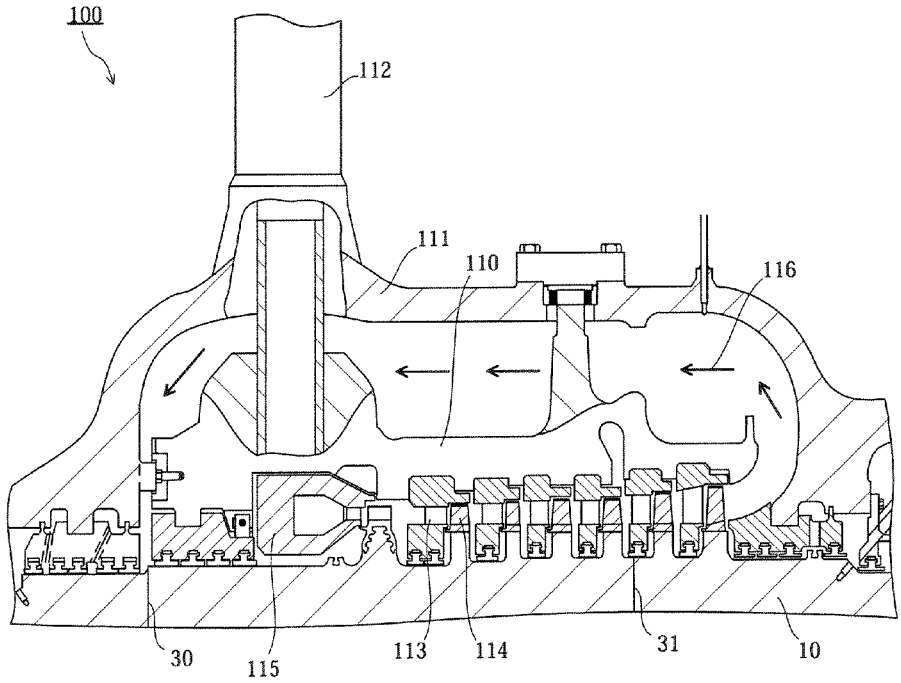
FIG. 2 is a sectional view of an upper-half casing portion of a high-pressure turbine provided with the turbine rotor according to the first embodiment of the invention.

FIG. 2 shows a sectional view of an upper-half casing portion of the high-pressure turbine 100 provided with the turbine rotor 10.

As shown in FIG. 2, the high-pressure turbine 100 has a double-structured casing which is comprised of an inner casing 110 and an outer casing 111 which is disposed to cover it. The turbine rotor 10 is disposed through the inner casing 110. For example, a seven stage nozzle 113 is disposed on the inner surface of the inner casing 110, and moving blades 114 are implanted in the turbine rotor 10. Besides, a main steam pipe 112 is disposed on the high-pressure turbine 100 through the outer casing 111 and the inner casing 110, and an end of the main steam pipe 112 is connected to communicate with a nozzle box 115 which discharges steam toward the moving blades 114.

The high-pressure turbine 100 is also provided with an outer casing cooling unit which cools the outer casing 111 by introducing part of the steam having performed the expansion work between the inner casing 110 and the outer casing 111 as cooling steam 116.

Subsequently, an operation of steam in the high-pressure turbine 100 will be described.

The steam having a high temperature of 650° C. or more, e.g., about 700° C., which has flown into the nozzle box 115 within the high-pressure turbine 100 through the main steam pipe 112, rotates the turbine rotor 10 by flowing through the steam passage between the nozzle 113 fixed to the inner casing 110 and the moving blades 114 (the front high-temperature moving blade section 23 and the rear low-temperature moving blade section 24) implanted in the turbine rotor 10. A large force is applied to the individual portions of the turbine rotor 10 due to the great centrifugal force caused by the rotations.

The operation of steam on the turbine rotor 10 will be described in detail.

Steam having a high temperature of about 700° C. discharged from the nozzle box 115 flows to the front side (a left-side portion of the front high-temperature moving blade section 23 in FIG. 1) of the front high-temperature moving blade section 23. At this time, the metal temperature of the front side of the front high-temperature moving blade section 23 becomes about 700° C. This high-temperature steam performs an expansion work at the front high-temperature moving blade section 23, and the steam temperature becomes 580° C. or less at the final stage in the front high-temperature moving blade section 23. Therefore, the metal temperature downstream of the final stage of the front high-temperature moving blade section 23 is kept at 580° C. or less. In other words, the bonded portion 31 between the front high-temperature moving blade section 23 and the rear low-temperature moving blade section 24, the rear low-temperature moving blade section 24, the rear low-temperature packing part 25 and the rear shaft 26 are kept at a metal temperature of 580° C. or less. The bonded portion 31 and the rear low-temperature moving blade section 24, the rear low-temperature packing part 25 and the rear shaft 26 which are made of the CrMoV steels (M1, M2) having the chemical compositions described above can secure satisfactory strength in a temperature range of 580° C. or less. The Ni-base alloy configuring the front high-temperature moving blade section 23 and the CrMoV steel configuring the rear low-temperature moving blade section 24 have a similar level of coefficient of linear expansion without a large difference at a temperature of 580° C., so that a thermal stress generated in the bonded portion 31 can be reduced sufficiently.

Meanwhile, the high-temperature steam of about 700° C. discharged from the nozzle box 115 flows to the front high-temperature packing part 22 and flows toward the front low-temperature packing part 21. Low-temperature seal steam is mixed with the high-temperature steam of about 700° C. immediately before the high-temperature steam flows to the front low-temperature packing part 21, so that the steam temperature becomes 580° C. or less. And, the steam having a temperature of 580° C. or less flows to the bonded portion 30 between the front low-temperature packing part 21 and the front high-temperature packing part 22 and to the front low-temperature packing part 21. Therefore, the bonded portion 30, the front low-temperature packing part 21 and the front shaft 20 are kept at a metal temperature of 580° C. or less. The bonded portion 30 and the front low-temperature packing part 21 and the front shaft 20 which are made of the CrMoV steels (M1, M2) having the chemical compositions described above can secure sufficient strength in the above temperature range. And, the Ni-base alloy configuring the front high-temperature packing part 22 and the CrMoV steel configuring the front low-temperature packing part 21 have a similar level of coefficient of linear expansion without a large difference at a temperature of 580° C., so that a thermal stress generated in the bonded portion 30 can be reduced sufficiently.

The steam having performed the expansion work in the front high-temperature moving blade section 23 and the rear low-temperature moving blade section 24 is mostly exhausted, flown into a boiler through an unshown low-temperature reheat pipe and heated therein. Meanwhile, the steam having performed the expansion work is partially guided as the cooling steam 116 between the inner casing 110 and the outer casing 111 to cool down the outer casing 111. This cooling steam 116 is exhausted from the front low-temperature packing part 21 or the discharge path through which the steam having performed the expansion work is mostly exhausted.

As described above, according to the steam turbine provided with the turbine rotor 10 of the first embodiment, the generation of the thermal stress in the bonded portion can be suppressed because the turbine rotor 10 is separately configured of the portion made of the Ni-base alloy and the portion made of the CrMoV steel depending on the steam temperature and the metal temperature, and the individual portions having a small difference in coefficient of linear expansion are welded mutually. And, the bonded portion between the portion made of the Ni-base alloy and the portion made of the CrMoV steel and the portion made of the CrMoV steel are kept at a metal temperature of 580° C. or less, so that the high-temperature steam of 650° C. or more can be introduced and the thermal efficiency can be improved.

Second Embodiment

Figure 3:
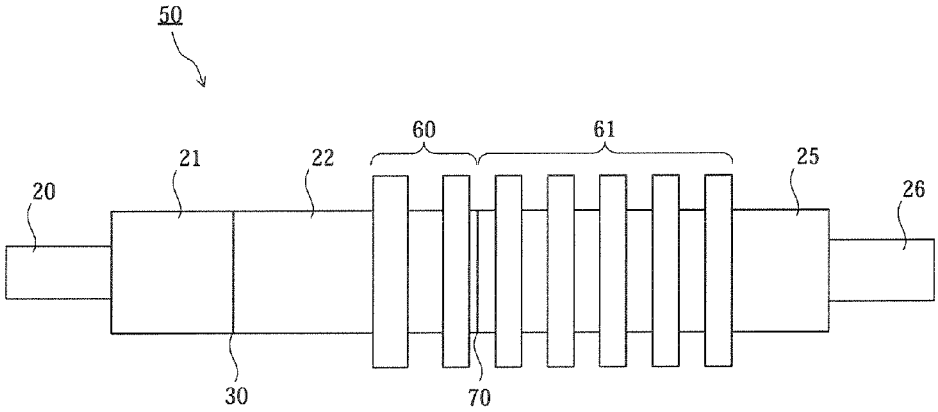
FIG. 3 is a plan view schematically showing the structure of a turbine rotor according to a second embodiment of the invention.

FIG. 3 is a plan view schematically showing the structure of a turbine rotor 50 according to a second embodiment of the invention. Like component parts which are the same as those of the turbine rotor 10 according to the first embodiment are denoted by like reference numerals, and overlapped descriptions will be omitted or simplified.

The turbine rotor 50 according to the second embodiment is configured in the same manner as the turbine rotor 10 of the first embodiment except that the structures of the front high-temperature moving blade section 23 and the rear low-temperature moving blade section 24 of the turbine rotor 10 according to the first embodiment are changed and a cooling unit is disposed. As shown in FIG. 3, the turbine rotor 50 is comprised of a front shaft 20, a front low-temperature packing part 21, a front high-temperature packing part 22, a front high-temperature moving blade section 60, a rear low-temperature moving blade section 61, a rear low-temperature packing part 25, a rear shaft 26, and an unshown cooling unit.

A bonded portion 70 between the front high-temperature moving blade section 60 and the rear low-temperature moving blade section 61 of the turbine rotor 50 is formed at a position exposed to steam having a temperature higher than 580° C. The bonded portion 70 between the front high-temperature moving blade section 60 and the rear low-temperature moving blade section 61 is a portion bonded by welding in the same manner as in the first embodiment. The bonded portion 70 and the rear low-temperature moving blade section 61 which are exposed to steam having a temperature higher than 580° C. are provided with an unshown cooling unit to keep the bonded portion 70 and the rear low-temperature moving blade section 61 at a metal temperature of 580° C. or less.

The cooling unit is not limited to a particular structure, but the bonded portion 70 and the rear low-temperature moving blade section 61 may be prevented from being exposed to steam having a temperature higher than 580° C. by, for example, blowing cooling steam having a temperature lower than 580° C. to the surfaces of the bonded portion 70 and the rear low-temperature moving blade section 61 which are exposed to the steam having a temperature higher than 580° C. And, the rear low-temperature moving blade section 61 may be cooled by flowing the cooling steam into the rear low-temperature moving blade section 61. Besides, the rear low-temperature moving blade section 61 may be prevented from being exposed to the steam having a temperature higher than 580° C. by a film of cooling steam which is formed on the surface of the rear low-temperature moving blade section 61 by spraying the cooling steam from the interior of the rear low-temperature moving blade section 61 to flow along the surface.

The front high-temperature moving blade section 60 is made of the same material as that of the front high-temperature moving blade section 23 of the first embodiment, and the rear low-temperature moving blade section 61 is made of the same material as tat of the rear low-temperature moving blade section 24 of the first embodiment.

As described above, according to the turbine rotor 50 of the second embodiment, the bonded portion 70 and the rear low-temperature moving blade section 61 can be disposed in a region exposed to steam having a temperature higher than 580° C. because the cooling unit is disposed. Thus, the turbine rotor manufacturing cost can be reduced because the portions made of the expensive Ni-base alloy can be decreased. And, the turbine rotor 50 is separately configured of the portion made of the Ni-base alloy and the portion made of the CrMoV steel, and those portions having a little difference in coefficient of linear expansion are mutually bonded by welding, so that thermal stress can be suppressed from generating in the bonded portion. And, it is possible to use the turbine rotor 50 as a turbine rotor disposed in the steam turbine in which high-temperature steam of 650° C. or more is introduced by keeping the bonded portion between the portion made of the Ni-base alloy and the portion made of the CrMoV steel and the portion made of the CrMoV steel at a metal temperature of 580° C. or less.

Then, a high-pressure turbine 100 provided with the turbine rotor 50 of the above-described second embodiment will be described below. This high-pressure turbine 100 provided with the turbine rotor 50 is configured in the same manner as the high-pressure turbine 100 provided with the turbine rotor 10 of the first embodiment shown in FIG. 2. Therefore, the operation of steam in the high-pressure turbine 100 will be described with reference to FIG. 2 and FIG. 3. An example that the high-pressure turbine 100 is provided with the turbine rotor 50 is described below, but the same action and effect can also be obtained by disposing the turbine rotor 50 in a high-pressure turbine or an intermediate-pressure turbine.

Steam having a high temperature of 650° C. or more, e.g., about 700° C., which has flown into the nozzle box 115 within the high-pressure turbine 100 through the main steam pipe 112 rotates the turbine rotor 50 by flowing through the steam passage between the nozzle 113 fixed to the inner casing 110 and the moving blades 114 (the front high-temperature moving blade section 60 and the rear low-temperature moving blade section 61) implanted in the turbine rotor 50. A large force is applied to the individual portions of the turbine rotor 50 due to the great centrifugal force caused by the rotations.

The operation of steam in the turbine rotor 50 will be described in detail.

Steam having a high temperature of about 700° C. discharged from the nozzle box 115 flows to the front side (a left-side portion of the front high-temperature moving blade section 60 in FIG. 3) of the front high-temperature moving blade section 60. At this time, the metal temperature of the front side of the front high-temperature moving blade section 60 becomes about 700° C. This high-temperature steam performs an expansion work at the front high-temperature moving blade section 60, but because the number of stages in the front high-temperature moving blade section 60 is small, the steam temperature becomes 580° C. or more even at the final stage in the front high-temperature moving blade section 60. And, cooling steam having a temperature lower than 580° C. is flown by the cooling unit to the surfaces of the bonded portion 70 and the rear low-temperature moving blade section 61 which are exposed to steam having a temperature higher than 580° C., so that the bonded portion 70 and the rear low-temperature moving blade section 61 are not exposed to the steam of 580° C. or more. Thus, the bonded portion 70 and the rear low-temperature moving blade section 61 are kept at a metal temperature of 580° C. or less. The bonded portion 70 and the rear low-temperature moving blade section 61, the rear low-temperature packing part 25 and the rear shaft 26 which are made of the CrMoV steels (M1, M2) having the chemical compositions described above can secure satisfactory strength in the above temperature range. And, the Ni-base alloy configuring the front high-temperature moving blade section 60 and the CrMoV steel configuring the rear low-temperature moving blade section 61 have a similar level of coefficient of linear expansion without a large difference at a temperature of 580° C., so that a thermal stress generated in the bonded portion 70 can be reduced sufficiently.

Meanwhile, the high-temperature steam of about 700° C. discharged from the nozzle box 115 flows to the front high-temperature packing part 22 and flows toward the front low-temperature packing part 21. Low-temperature seal steam is mixed with the high-temperature steam of about 700° C. immediately before the high-temperature steam flows to the front low-temperature packing part 21, so that the steam temperature becomes 580° C. or less. And, the steam having a temperature of 580° C. or less flows to the bonded portion 30 between the front low-temperature packing part 21 and the front high-temperature packing part 22 and the front low-temperature packing part 21. Therefore, the bonded portion 30, the front low-temperature packing part 21 and the front shaft 20 are kept at a metal temperature of 580° C. or less. The bonded portion 30 and the front low-temperature packing part 21 and the front shaft 20 which are made of the CrMoV steels (M1, M2) having the chemical compositions described above can secure sufficient strength in the above temperature range. And, the Ni-base alloy configuring the front high-temperature packing part 22 and the CrMoV steel configuring the front low-temperature packing part 21 have a similar level of coefficient of linear expansion without a large difference at a temperature of 580° C., so that a thermal stress generated in the bonded portion 30 can be reduced sufficiently.

The steam having performed the expansion work in the front high-temperature moving blade section 60 and the rear low-temperature moving blade section 61 is mostly exhausted, flown into a boiler through an unshown low-temperature reheat pipe and heated therein. Meanwhile, the steam having performed the expansion work is partially guided as the cooling steam 116 between the inner casing 110 and the outer casing 111 to cool down the outer casing 111. This cooling steam 116 is exhausted from the front low-temperature packing part 21 or the discharge path through which the steam having performed the expansion work is mostly exhausted.

As described above, according to the steam turbine provided with the turbine rotor 50 of the second embodiment, the bonded portion 70 and the rear low-temperature moving blade section 61 can be disposed in the region exposed to the steam having a temperature higher than 580° C. because the cooling unit is disposed. Accordingly, the steam turbine manufacturing cost can be reduced because the portions made of the expensive Ni-base alloy can be decreased. The turbine rotor 50 is separately configured of the portion which is made of the Ni-base alloy and the portion which is made of the CrMoV steel, and the individual portions having a small difference in coefficient of linear expansion are bonded by welding, so that the generation of thermal stress in the bonded portion can be suppressed. And, the bonded portion between the portion made of the Ni-base alloy and the portion made of the CrMoV steel and the portion made of the CrMoV steel are kept at a metal temperature of 580° C. or less, so that the high-temperature steam of 650° C. or more can be introduced and the thermal efficiency can be improved.

EXAMPLE 1 AND COMPARATIVE EXAMPLE 1

Here, the Ni-base alloy and the CrMoV steel used for the turbine rotor of the invention described above were used to configure a test sample 1 (Example 1) by welding the Ni-base alloy and the CrMoV steel, and the Ni-base alloy and the 12Cr steel used for a conventional dissimilar metal welding type turbine rotor were used to configure a test sample 2 (Comparative Example 1) by welding the Ni-base alloy and the 12Cr steel. And, the thermal stresses generated in the bonded portions were calculated.

The test sample 1 was prepared by welding the cross sections of a cylindrical body having a diameter of 800 mm and a length of 1000 mm of the Ni-base alloy and a cylindrical body having a diameter of 800 mm and a length of 1000 mm of the CrMoV steel. IN617 (manufactured by Inco Ltd.) was used as the Ni-base alloy. And, a difference in coefficient of linear expansion between the used Ni-base alloy and CrMoV steel at 580° C. was $0.3\times10^{-6}$/° C.

The test sample 2 was prepared by welding the cross sections of a cylindrical body having a diameter of 800 mm and a length of 1000 mm of the Ni-base alloy and a cylindrical body having a diameter of 800 mm and a length of 1000 mm of the 12Cr steel. IN617 (manufactured by Inco Ltd.) was used as the Ni-base alloy, and new 12Cr steel was used as the 12Cr steel. And, a difference in coefficient of linear expansion between the used Ni-base alloy and 12Cr steel at 580° C. was $2.8\times10^{-6}$/° C.

The thermal stresses were calculated to find that the test sample 1 had thermal stress of 28.8 MPa, and the test sample 2 had thermal stress of 269 MPa. It is apparent from the results that the thermal stress in the bonded portion of the test sample 1 was smaller than that in the bonded portion of the test sample 2.

The embodiments described above are not exclusive but can be expanded or modified without departing from the scope of the present invention, and the expanded or modified embodiments are also to be embraced within the technical scope of the invention.

What is claimed is:

1. A turbine rotor disposed in a steam turbine into which high-temperature steam of 650° C. or higher is introduced during operation of the steam turbine, wherein the turbine rotor is configured by welding to bond a portion made of an Ni-base alloy which can be used stably up to a temperature of 650° C. or higher and a portion made of CrMoV steel, which are divided depending on a temperature of steam, and wherein (i) the bonded portion between the portion made of the Ni-base alloy and the portion made of the CrMoV steel, and (ii) the portion made of the CrMoV steel are positioned at a location on the turbine rotor where the steam temperature 580° C. or lower during operation of the steam turbine.

2. A turbine rotor disposed in a steam turbine into which high-temperature steam of 650° C. or higher is introduced during operation of the steam turbine, wherein the turbine rotor is configured by welding to bond a portion made of an Ni-base alloy which can be used stably up to a temperature of 650° C. or higher and a portion made of CrMoV steel, which are divided depending on a metal temperature, and wherein a cooling unit is disposed at the portion made of the CrMoV steel and the bonded portion between the portion made of the Ni-base alloy and the portion made of the CrMoV steel to keep the bonded portion and the portion made of the CrMoV steel, which are exposed to steam having a temperature higher than 580° C. during operation of the steam turbine, at a metal temperature of 580° C. or lower during operation of the steam turbine.

3. The turbine rotor according to claim 1, wherein a difference between a coefficient of linear expansion of the Ni-base alloy and that of the CrMoV steel is $2\times10^{-6}$/° C. or less at the temperature of the welded portion in use.

4. The turbine rotor according to claim 2, wherein a difference between a coefficient of linear expansion of the Ni-base alloy and that of the CrMoV steel is $2\times10^{-6}$/° C. or less at the temperature of the welded portion in use.

5. The turbine rotor according to claim 1, wherein the Ni-base alloy contains in percent by weight C: 0.05 to 0.15, Si: 0.01 to 1, Mn: 0.01 to 1, Cr: 20 to 24, Mo: 8 to 10, Co: 10 to 15, B: 0.0001 to 0.006, Al: 0.8 to 1.5, Ti: 0.1 to 0.6, and the balance of Ni and unavoidable impurities, and the unavoidable impurities include Fe: 3 or less, Cu: 0.5 or less, and S: 0.015 or less.

6. The turbine rotor according to claim 2, wherein the Ni-base alloy contains in percent by weight C: 0.05 to 0.15, Si: 0.01 to 1, Mn: 0.01 to 1, Cr: 20 to 24, Mo: 8 to 10, Co: 10 to 15, B: 0.0001 to 0.006, Al: 0.8 to 1.5, Ti: 0.1 to 0.6, and the balance of Ni and unavoidable impurities, and the unavoidable impurities include Fe: 3 or less, Cu: 0.5 or less, and S: 0.015 or less.

7. The turbine rotor according to claim 1, wherein the Ni-base alloy contains in percent by weight C: 0.001 to 0.06, Si: 0.01 to 0.4, Cr: 14 to 18, B: 0.0001 to 0.006, Al: 0.1 to 3, Ti: 0.1 to 2, Ni: 39 to 44, and the balance of Fe and unavoidable impurities, and the unavoidable impurities include Mn: 0.4 or less, Co: 1 or less, Cu: 0.3 or less, and S: 0.015 or less.

8. The turbine rotor according to claim 2, wherein the Ni-base alloy contains in percent by weight C: 0.001 to 0.06, Si: 0.01 to 0.4, Cr: 14 to 18, B: 0.0001 to 0.006, Al: 0.1 to 3, Ti: 0.1 to 2, Ni: 39 to 44, and the balance of Fe and unavoidable impurities, and the unavoidable impurities include Mn: 0.4 or less, Co: 1 or less, Cu: 0.3 or less, and S: 0.015 or less.

9. The turbine rotor according to claim 1, wherein the Ni-base alloy contains in percent by weight C: 0.01 to 0.1, Cr: 8 to 15, Mo: 16 to 20, Al: 0.8 to 1.5, Ti: 0.1 to 1.5, and the balance of Ni and unavoidable impurities.

10. The turbine rotor according to claim 2, wherein the Ni-base alloy contains in percent by weight C: 0.01 to 0.1, Cr: 8 to 15, Mo: 16 to 20, Al: 0.8 to 1.5, Ti: 0.1 to 1.5, and the balance of Ni and unavoidable impurities.

11. The turbine rotor according to claim 1, wherein the Ni-base alloy contains in percent by weight C: 0.01 to 0.2, Cr: 15 to 25, Mo: 8 to 12, Co: 5 to 15, Al: 0.8 to 1.5, Ti: 0.1 to 2, and the balance of Ni and unavoidable impurities.

12. The turbine rotor according to claim 2, wherein the Ni-base alloy contains in percent by weight C: 0.01 to 0.2, Cr: 15 to 25, Mo: 8 to 12, Co: 5 to 15, Al: 0.8 to 1.5, Ti: 0.1 to 2, and the balance of Ni and unavoidable impurities.

13. The turbine rotor according to claim 1, wherein the Ni-base alloy contains in percent by weight C: 0.01 to 0.2, Cr: 10 to 20, Mo: 8 to 12, Al: 4 to 8, Ti: 0.1 to 2, Nb: 0.1 to 3, and the balance of Ni and unavoidable impurities.

14. The turbine rotor according to claim 2, wherein the Ni-base alloy contains in percent by weight C: 0.01 to 0.2, Cr: 10 to 20, Mo: 8 to 12, Al: 4 to 8, Ti: 0.1 to 2, Nb: 0.1 to 3, and the balance of Ni and unavoidable impurities.

15. The turbine rotor according to claim 1, wherein the CrMoV steel contains in percent by weight C: 0.24 to 0.34, Si: 0.15 to 0.35, Mn: 0.7 to 1, Cr: 0.85 to 2.5, V: 0.2 to 0.3, Mo: 1 to 1.5, and the balance of Fe and unavoidable impurities, and the unavoidable impurities include Ni: 0.5 or less, P: 0.035 or less, and S: 0.035 or less.

16. The turbine rotor according to claim 2, wherein the CrMoV steel contains in percent by weight C: 0.24 to 0.34, Si: 0.15 to 0.35, Mn: 0.7 to 1, Cr: 0.85 to 2.5, V: 0.2 to 0.3, Mo: 1 to 1.5, and the balance of Fe and unavoidable impurities, and the unavoidable impurities include Ni: 0.5 or less, P: 0.035 or less, and S: 0.035 or less.

17. A steam turbine into which high-temperature steam of 650° C. or higher is introduced, being provided with the turbine rotor according to claim 1.

18. A steam turbine into which high-temperature steam of 650° C. or higher is introduced, being provided with the turbine rotor according to claim 2.

* * * * *